US007380557B2

(12) United States Patent
Shiraishi

(10) Patent No.: US 7,380,557 B2
(45) Date of Patent: Jun. 3, 2008

(54) METHOD OF FLUSHING A COIL PIPES(S) OF A HEAT EXCHANGER

(75) Inventor: Tadashi Shiraishi, Tokyo (JP)

(73) Assignee: Tokai Engineering Co., Ltd., Tokyo (JP)

( * ) Notice: Subject to any disclaimer, the term of this patent is extended or adjusted under 35 U.S.C. 154(b) by 14 days.

(21) Appl. No.: 10/699,136

(22) Filed: Oct. 31, 2003

(65) Prior Publication Data

US 2004/0226580 A1 Nov. 18, 2004

(30) Foreign Application Priority Data

May 14, 2003 (JP) ..... 2003-135595

(51) Int. Cl.
*B08B 9/02* (2006.01)

(52) U.S. Cl. ..... 134/22.1; 134/6; 134/7; 134/8; 134/22.11; 134/22.12; 134/22.18; 134/34; 134/36; 134/42

(58) Field of Classification Search ..... 134/166 R, 134/166 C, 169 R, 6, 7, 8, 22.1, 22.11, 22.12, 134/22.18, 34, 36, 42
See application file for complete search history.

(56) References Cited

U.S. PATENT DOCUMENTS

| | | | | |
|---|---|---|---|---|
| 4,007,774 | A * | 2/1977 | Withers, Jr. | 165/97 |
| 4,220,012 | A * | 9/1980 | Brister | 62/130 |
| 4,327,560 | A * | 5/1982 | Leon et al. | 62/260 |
| 4,724,007 | A * | 2/1988 | Barry et al. | 134/1 |
| 5,081,068 | A * | 1/1992 | Endo et al. | 134/2 |
| 5,160,548 | A * | 11/1992 | Boisture | 134/7 |
| 5,499,639 | A * | 3/1996 | Williams, Jr. | 134/7 |
| 5,680,877 | A * | 10/1997 | Edstrand et al. | 134/103.1 |
| 5,934,566 | A * | 8/1999 | Kanno et al. | 239/398 |
| 6,041,811 | A * | 3/2000 | Walter et al. | 137/334 |
| 6,485,577 | B1 * | 11/2002 | Kiholm | 134/8 |
| 2003/0140944 | A1 * | 7/2003 | Quarini | 134/8 |
| 2004/0226580 | A1 * | 11/2004 | Shiraishi | 134/22.1 |

FOREIGN PATENT DOCUMENTS

| | | |
|---|---|---|
| JP | 52-34482 | 8/1977 |
| JP | 58-3686 | 1/1983 |
| JP | 58-156385 | 9/1983 |
| JP | 58-156386 | 9/1983 |
| JP | 1-28625 | 11/1986 |

(Continued)

*Primary Examiner*—Sharidan Carrillo
(74) *Attorney, Agent, or Firm*—Jordan and Hamburg LLP

(57) ABSTRACT

A heat exchanger coil pipe is internally cleaned off dirt deposits by forcing ice and water to pass the pipe. A system for carrying out the cleaning comprises a suction pump, a wastewater collecting tank, a suction hose for connection between the waste and wash water collecting tank and a heat transfer medium inlet or outlet of the pipe and an ice-feeding hose provided at one end with a hopper and connectable at the other end to the heat transfer medium outlet or inlet pipe. In the state of the suction hose being connected to the heat transfer medium inlet or outlet and the suction hose being connected to the heat transfer medium outlet or inlet, ice and water are supplied from the hopper and drawn into the ice by suction from the suction pump to flow in the coil pipe and collected into the wastewater collecting tank.

22 Claims, 3 Drawing Sheets

FOREIGN PATENT DOCUMENTS

| | | | | |
|---|---|---|---|---|
| JP | 1-30549 | | | 6/1987 |
| JP | 4-45223 | | | 7/1992 |
| JP | 05261349 | A | * | 10/1993 |
| JP | 05-261349 | | * | 11/1993 |
| JP | 05-261349 | | * | 12/1993 |
| JP | 9-61092 | | | 3/1997 |
| JP | 11-153373 | | | 6/1999 |
| JP | 2001-300456 | | | 10/2001 |
| JP | 2002-162175 | | | 6/2002 |
| RU | 1141153 | | * | 2/1985 |

* cited by examiner

METHOD OF FLUSHING A COIL PIPES(S) OF A HEAT EXCHANGER

BACKGROUND OF THE INVENTION

The present invention relates to a method of cleaning the inside of a coil pipe(s) of a heat exchanger and, more specifically, to a method of cleaning the inside of the cooling coil pipe(s) or heating coil pipe(s) of the heat exchanger by forcing water and ice to flow in the coil pipe(s) for removing off dirt deposits such as slime, sludge and residue.

As well known, a heat exchanger transfers heat from a heat transfer medium (e.g., water or steam) passing through in a coil pipe(s) to other medium (e.g., air or water) flowing along the outside of the coil pipe(s) to cool or heat the latter. Dirt deposited in the coil pipe(s) results in a decrease in working efficiency of the heat exchanger. For example, the decreased cooling or heating ability of air conditioners is resulted in most cases from dirt deposits in the cooling or heating coil pipe(s). Namely, the dirt deposited in the coil pipe(s) may prevent the heat exchange between the heating or cooling medium flowing therein and the air flowing along the outside of the coil pipe(s). The buildup of slime, sludge and residue in the coil pipe(s) may also reduce the passage of heat transfer medium (cold or hot water in case of air conditioner) in the coil pipe(s), resulting in lowering the flow rate of the medium flowing therein than the nominal value necessary for achieving designed temperature difference between two fluids cannot be achieved.

For example, a cooling coil pipe(s) or heating coil pipe(s) of a heat exchanger (for chilled or hot water) of an air conditioner may be severely fouled in 10-15 years' use. This results in lowered cooling or heating capacity and shortening the service life of the device. To recover the capacity of the air conditioner, it is usually conducted to increase the airflow rate, wash the fin side (air side) of the heat exchanger coil pipe(s) with high-pressure water and, in rare cases, clean the inside of the heat exchanger coil pipe(s) (heat transfer side) with cleaning agent.

As described above, a heat exchanger coil pipe(s) is usually cleaned by washing its outside wall (air side) and, in rare cases, by flushing its inside wall (water side) with chemical solution. With regard to waste piping, the present applicant has proposed washing the inside of waste pipes with ice cubes in Japanese Patent Publication No. 1-28625.

However, the use of cleaning chemicals is accompanied by a risk of corroding the inside wall of the heat exchanger coil pipe(s) and polluting the environment with waste solution containing residue of chemicals. Therefore, there has been desired a method of cleaning the inside of heat exchanger coil pipe(s), which is friendly both to the heat exchanger coil pipe(s) and the ecological environment. The present invention is directed to a cleaning method that can satisfy the above-described requirements.

SUMMARY OF THE INVENTION

An object of the present invention is to provide a method of cleaning the inside of a heat exchanger coil pipe(s), which comprises a suction pump, a waste water collecting tank, a suction hose for connection between a heat transfer medium inlet or outlet of the heat exchanger coil pipe(s) and an inlet port of the waste water collecting tank and an ice supply hose provided at its one end with a hopper and connected at its other end to the outlet or inlet of the heat exchanger coil pipe(s), whereby the inside of the coil pipe(s) is cleaned with ice and water supplied thereto from the hopper through the ice supply hose, which by suction from the suction pump passes through the coil pipe(s) and enters into the waste water collecting tank.

Another object of the present invention is to provide a method of cleaning the inside of a heat exchanger coil pipe(s), whereby the cleaning is repeated in reverse direction by exchanging the connection of the inlet or outlet of the coil pipe(s) to the suction hose for the connection to the ice supply hose and by supplying ice and water into the coil pipe(s) and collecting the waste into the tank.

Another object of the present invention is to provide a method of cleaning the inside of a heat exchanger coil pipe(s), wherein the waste-and-wash water passing the heat exchanger coil pipe(s) is visually monitored in the transparent portion of the ice supply hose.

Another object of the present invention is to provide a method of cleaning the inside of a heat exchange coil pipe(s), whereby a mixture of ice and water, prepared in the ratio of 1 (ice) to 4~6 (water), is supplied from the hopper into the coil pipe(s).

Another object of the present invention is to provide a method of cleaning the inside of a heat exchange coil pipe(s), whereby ice is prepared in form of cubes each having a side length corresponding to ⅓-⅔ of an inner diameter of the coil pipe(s) to be cleaned.

PREFERRED EMBODIMENT OF THE INVENTION

Figure 1:
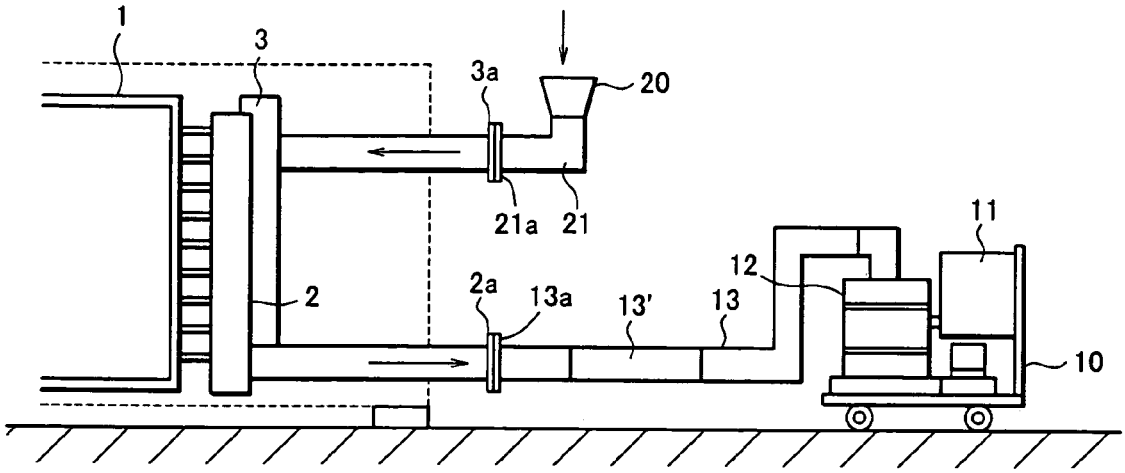
FIG. 1 is a view for explaining an example of a system for cleaning the inside of heat exchanger coil pipe(s), which carries out the cleaning method according to the present invention when cleaning the inside of a heat exchanger coil pipe(s) of an air conditioner.

FIG. 1 illustrates an essential portion of a system for carrying out the method of the present invention for cleaning the inside of a heat exchanger coil pipe(s). The method of the present invention will be described by way of example and with reference to FIG. 1 when it is applied to the cleaning of a heat exchanger coil pipe(s) of an air conditioner. However, this method is not limited to the cleaning of the air conditioner coil pipe(s) (for heat transfer between water and air) and can be applied to heat exchanger coil pipe(s) for transferring heat from water to water, steam to water, steam to air. In FIG. 1, there is shown an air conditioner (heat exchanger) 1 having a heat exchanger coil pipe(s), a header 2 for supplying heat transfer medium (chilled water or hot water) into the heat exchanger coil pipe(s) of the air conditioner 1 and a discharging header 3 for discharging the heat transfer medium having passed the heat exchanger coil pipe(s) of the air conditioner. The air-conditioner 1 and the headers 2 and 3 are installed in a building. For example, the air-conditioner 1 is provided with at its rear side a fan for creating a stream of air from the rear side to the front side across the heat exchanger coil pipe(s) in which heat transfer medium (chilled water or hot water) flows. The air is deprived of heat or given heat by the heat transfer medium (chilled water or hot water) through the outside wall of the coil pipe(s). The stream of cooled or warmed air is thus supplied from the air conditioner.

Figure 2:
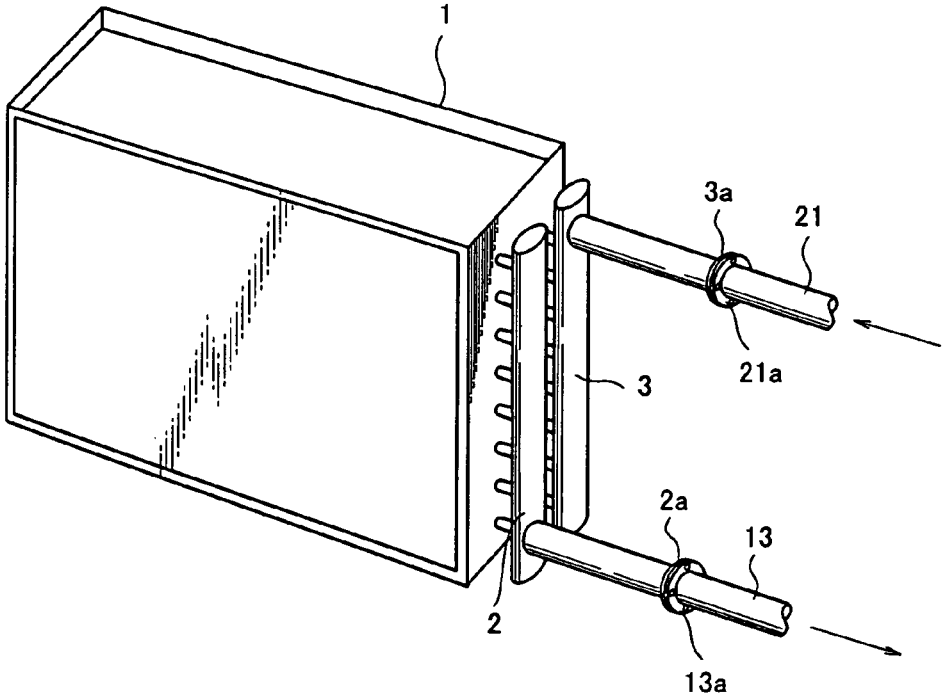
FIG. 2 is a perspective view of connections of a cleaning system with a heat exchanger coil pipe(s).

The present invention relates to a method of cleaning the inside of a heat exchanger coil pipe(s) as described above. In FIG. 1, there is shown a carriage 10 on which a suction pump 11 and a waste-and-wash water collecting tank 12 are mounted, and a hopper 20 for feeding ice and water. A heat transfer medium feeding pipe (not shown) and a heat transfer medium discharging pipe (not shown) are disconnected from an inlet 2*a* of the header 2 and an outlet 3*a* of the header 3 respectively. As shown in FIG. 2, in place of the removed pipes, a suction end 13*a* of a suction hose 13 is connected to the heat transfer medium (chilled or hot water) feeding inlet 2*a* of the header 2 and an ice-water feeding end 21*a* of the ice-and-water feeding hose 21 is connected to a heat transfer medium discharging port 3*a* of the header 3.

On completion of the connections of the cleaning system as shown in FIG. 1, the suction pump 11 is driven and, ice and water are supplied into the hopper 20. The mixture of ice and water flows through the feeding pipe 21 and the header 3 into the heat exchanger coil pipe(s) of the air conditioner 1, wherein slime, sludge and residual matters deposited on the inner wall of the coil pipe(s) are removed by impact energy of ice cubes and the force of water and washed away together with the ice and water through the header 2 and the suction hose 13 into the waste-and-wash water collecting tank 12.

As described above, according to the present invention, the ice and water (ice only, water only or a mixture of ice and water may be used in practical cases) is forced by suction from the suction pump to flow through the heat exchanger coil pipe(s) in which rust, fur and slime deposited on the inner wall of the coil pipe(s) are removed off by the impact of collision of ice cubes therewith and washed out by water stream together with sludge (dust and sand), weld slugs and pipe-cut chips remaining in the coil pipe(s).

As described above, according to the present invention, it is possible to:

(1) softly clean the inside of a heat exchanger coil pipe(s) with ice and water;
(2) remove dirt such as rust, fur and slime from the inner wall of the coil pipe(s);
(3) remove sludge such as dust and sand from the inside of the coil pipe(s); and
(4) remove residues such as welding and cutting chips from the inside of the coil pipe(s).

The cleaning method according to the present invention offers the following advantages:

(1) The inside of the coil pipe(s) can be softly washed with ice and water with no fear of damaging the inner wall of the coil pipe(s) (ice is softer than copper of which most of coil pipe(s) are made);
(2) There is no fear of accident by spouting of waste and rapture of the coil pipe(s) owing to a negative pressure in the coil pipe(s);
(3) Washing with ice and water does not pollute the environments;
(4) The method can be applied to old type heat exchangers which may be easily damaged and troubled with an increased leakage from pinholes and cracks when forcibly cleaning by other conventional methods. This method does not cause such a trouble.

The results of experiments indicate tat a mixture of ice and water, which was prepared in a ratio of 1 (ice): 5 (water), is suitable and the suitable size (one side length) of an ice cube corresponds to ⅓-⅔ of die inside diameter of a coil pipe(s) to be internally washed (for example, if the inside diameter of the coil pipe(s) is 15 mm, it is recommended to prepare ice cubes each having a side length of 5 to 10 mm)

The suction hose 13 having a transparent portion 13' through which the dirty degree of waste-and-wash water can be visually observed to easily judge the result of cleaning.

Figure 3:
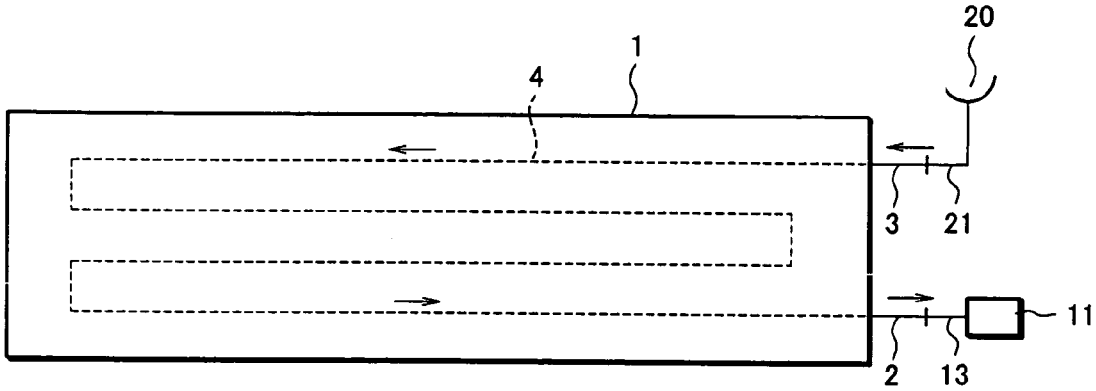
FIG. 3 shows an example of a flow of washing water through a heat exchanger coil pipe(s).
Figure 4:
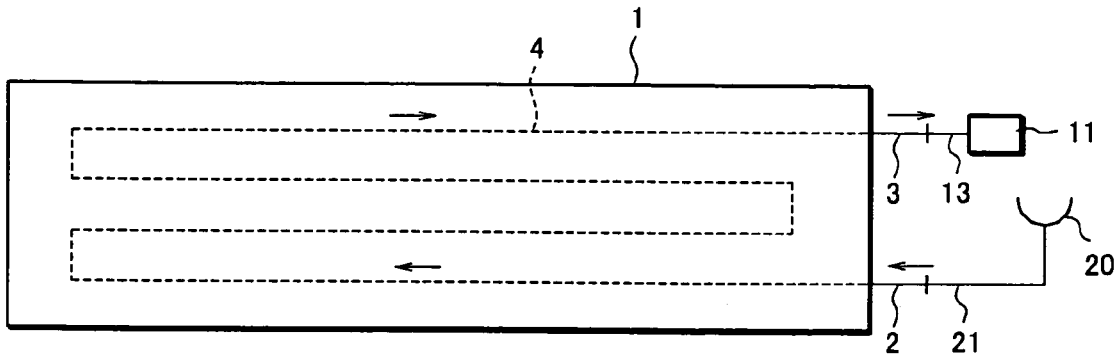
FIG. 4 shows an example of a reversed flow of washing water through a heat exchanger coil pipe(s).

After cleaning the inside of the coil pipe(s) in the condition shown in FIG. 1 (by the flow of the mixture of ice and water in the direction shown by arrows in FIG. 3), the suction hose 13 is connected to the header 3, the feeding hose 21 is connected to header 2, a mixture of ice and water is put into the hopper 20 and then the suction pump 11 is driven into operation. In this case, as shown in FIG. 4, the ice and water flow in the coil pipes 4 in the direction reverse to that in the previous cleaning as shown in FIG. 3. This reverse flushing can effectively clean the inside of the coil pipes 4. It is effective to repeat the above-described washing of the inside of the coil pipes 4 several times as necessary by alternately reversing the flow direction, i.e., in the directions reverse to each other as shown in FIGS. 3 and 4. By doing so, the inside of the coil pipes 4 can be further effectively cleaned.

Figure 5:
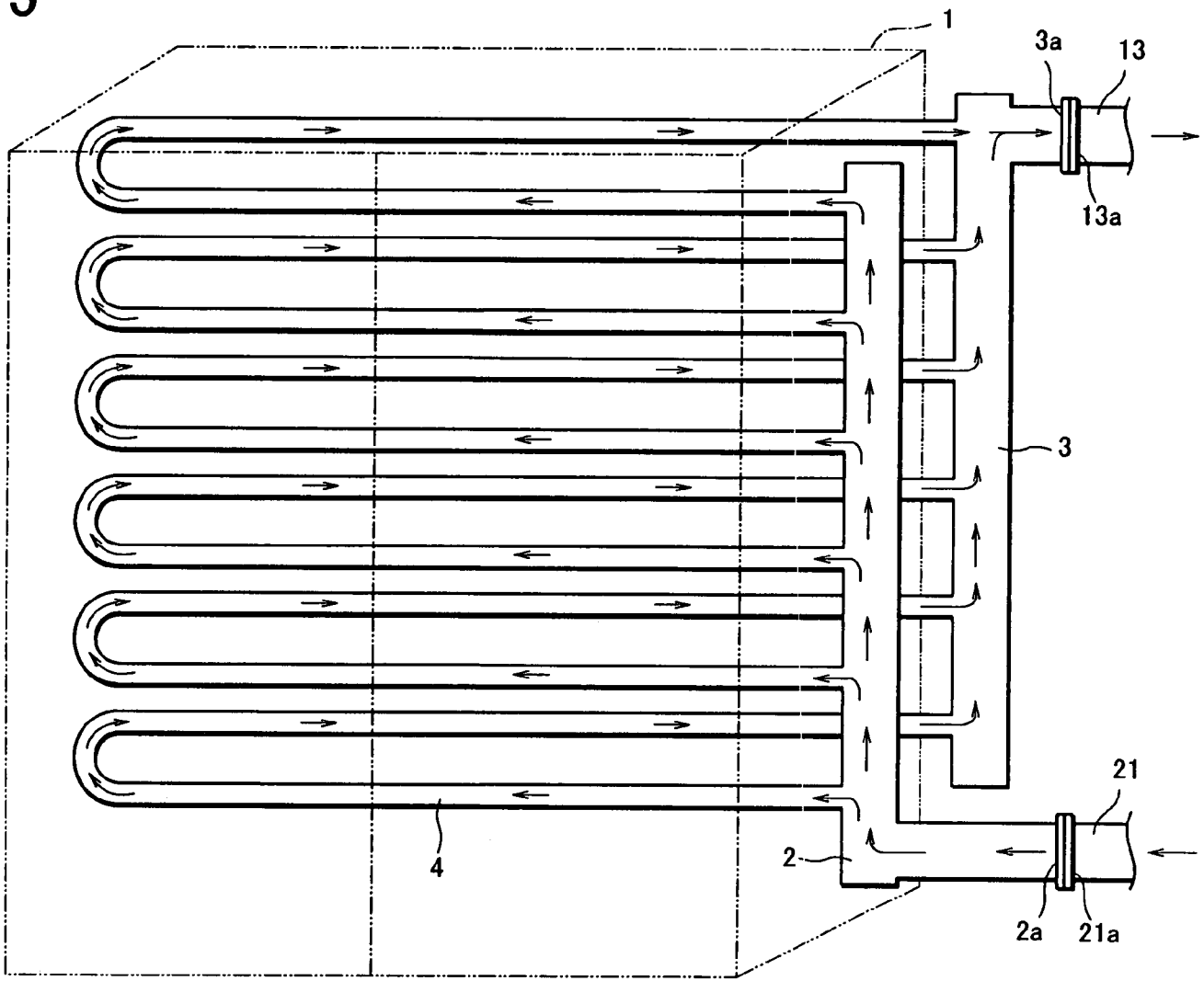
FIG. 5 shows an example of arrangement of a coil pipe(s) of a heat exchanger.

FIG. 5 shows an example of arrangement of a heat exchanger coil pipes 4 in an air conditioner 1 with arrows indicating how the mixture of ice and water flows in the coil pipes 4.

While washing the inside of coil pipes 4, the inner wall of the coil pipes 4 cannot be damaged by ice cubes since ice is softer than the copper coil pipes 4 and water can serves as lubricant. High negative pressure (vacuum) is created in the inside of the coil pipes by suction from the suction pump to achieve effective flushing with ice and water, removing dirt deposits from the inside wall of the coil pipes 4. The sticky dirt deposits can be washed away by repeating several times flushing with ice and water alternating the flushing direction, i.e., from the top to the bottom of the coil pipe and from the bottom to the top thereof.

The invention claimed is:

1. A method of internally cleaning a coil pipe of a heat exchanger, said heat exchanger including an outlet and an inlet providing fluid communication with said coil pipe, said method comprising:

(1) flushing said coil pipe in a first flow direction by:
connecting a first end of a suction hose to said heat exchanger inlet;
connecting a second end of said suction hose to a suction pump and a waste-and-wash water collecting tank; and
connecting one end of an ice-feeding hose to said heat exchanger outlet and a second end of said ice-feeding hose to a hopper;
supplying an ice and water mixture into said hopper;
engaging said suction pump to create a suction effective so that the ice and water are suctioned into said coil pipe outlet, pass internally through said coil pipe in a reverse flow direction towards said inlet, exit said inlet, and collect in said waste-and-wash water collecting tank, wherein a negative pressure created by said suction does not exceed a value equal in magnitude to ambient atmospheric pressure;

(2) flushing said coil pipe in a second flow direction by:
connecting said first end of said suction hose to said heat exchanger outlet;
connecting said second end of said suction hose to said suction pump and said waste-and-wash water collecting tank; and connecting said one end of said ice-feeding hose to said heat exchanger inlet and said second end of said ice-feeding hose to said hopper;

supplying said ice and water mixture into said hopper;

engaging said suction pump to create the suction effective so that the ice and water are suctioned into said coil pipe inlet, pass internally through said coil pipe in a normal flow direction towards said outlet, exit said outlet, and collect in said waste-and-wash water collecting tank, wherein the negative pressure created by said suction does not exceed the value equal in magnitude to said ambient atmospheric pressure ; and (3) alternately flushing said coil pipe in said first and second flow directions for cleaning said coil pipe.

2. The method according to claim 1, further comprising providing a transparent portion in said ice feeding hose for enabling visual inspection of the flow of waste-and-wash water therethrough.

3. The method according to claim 1, wherein the ice and water are mixed in a ratio of 1 (ice) to 4~6 (water).

4. The method according to claim 1, wherein the ice is prepared in a form of a cube having a side length of about ⅓-⅔ of an inside diameter of said heat exchanger coil pipe.

5. A method of internally cleaning a copper coil pipe of a heat exchanger, said heat exchanger including an outlet and an inlet providing fluid communication with said coil pipe, said method comprising:

(1) flushing said coil pipe in a first flow direction by:

connecting a first end of a suction hose to said heat exchanger inlet;

providing a carriage and disposing a suction pump and a waste-and-wash water collector tank on said carriage;

connecting a second end of said suction hose to said suction pump and said waste-and-wash water collecting tank; and connecting one end of an ice-feeding hose to said heat exchanger outlet and a second end of said ice-feeding hose to a hopper;

supplying an ice and water mixture into said hopper;

engaging said suction pump to create a suction effective so that the ice and water are suctioned into said coil pipe outlet, pass internally through said coil pipe in a reverse flow direction towards said inlet, exit said inlet, and collect in said waste-and-wash water collecting tank, wherein a negative pressure created by said suction does not exceed a value equal in magnitude to ambient atmospheric pressure;

(2) flushing said coil pipe in a second flow direction by:

connecting said first end of said suction hose to said heat exchanger outlet;

connecting said second end of said suction hose to said suction pump and said waste-and-wash water collecting tank; and connecting said one end of said ice-feeding hose to said heat exchanger inlet and said second end of said ice-feeding hose to said hopper;

supplying said ice and water mixture into said hopper;

engaging said suction pump to create the suction effective so that the ice and water are suctioned into said coil pipe inlet, pass internally through said coil pipe in said a normal flow direction towards said outlet, exit said outlet, and collect in said waste-and-wash water collecting tank, wherein the negative pressure created by said suction does not exceed the value equal in magnitude to said ambient atmospheric pressure; and (3) alternately flushing said coil pipe in said first and second flow directions;

whereby impact energy of said ice cubes and force from said water through said coil pipe and suction hose into said waste-and-wash water collecting tank clean said coil pipe.

6. The method according to claim 5, further comprising providing a transparent portion in said ice feeding hose for enabling visual inspection of the flow of waste-and-wash water therethrough.

7. The method according to claim 5, wherein the ice and water are mixed in a ratio of 1 (ice) to 4~6 (water).

8. The method according to claim 5, wherein the ice is prepared in a form of a cube having a side length of about ⅓-⅔ of an inside diameter of said heat exchanger coil pipe.

9. A method of internally cleaning a heat exchanger having at least two coil pipes interconnecting a first header and a second header, said method comprising:

connecting a hopper containing an ice and water mixture to a one of said first header or said second header; and applying suction to a remaining one of said first header or said second header to cause said ice and water mixture to be suctioned into said one of said first header or said second header and to simultaneously pass internally through said at least two coil pipes, wherein a negative pressure created by said suction does not exceed a value equal in magnitude to ambient atmospheric pressure by.

10. The method according to claim 9, wherein said one of said first header or said second header is an inlet header, and said remaining one of said first header or said second header is an outlet header.

11. The method according to claim 10, further comprising repeating said method wherein said one of said first header or said second header is said outlet header and said remaining one of said first header or said second header is said inlet header.

12. The method according to claim 11, further comprising repeating said method wherein said one of said first header or said second header alternates between being one of said inlet header or said outlet header and said remaining one of said first header or said second header alternates between being a respective remaining one of said inlet header or said outlet header.

13. The method according to claim 11, wherein said coil pipes are non-corrugated.

14. A method of internally cleaning a coil pipe of a heat exchanger, said heat exchanger including an outlet and an inlet providing fluid communication with said coil pipe, said method comprising:

connecting a hopper containing an ice and water mixture to a one of said inlet or said outlet; and applying suction to a remaining one of said inlet or said outlet so that the ice and water mixture is suctioned from said hopper into said one of said inlet or said outlet and caused to flow internally through said coil pipe towards said remaining one of said inlet or outlet, wherein a negative pressure created by said suction does not exceed a value equal in magnitude to ambient atmospheric pressure.

15. The method according to claim 14, further comprising monitoring a degree of dirt contained in said ice and water mixture flowing internally through said coil pipe by visually observing the ice and water mixture exiting from said remaining one of said inlet or said outlet of said coil pipe though a transparent portion of a suction hose communicative therewith and which provides said suction to said remaining one of said inlet or said outlet.

16. The method according to claim 14, wherein the ice and water mixture comprises an ice:water ratio of 1 (ice) to 4~6 (water).

17. The method according to claim 14, wherein the ice comprising said ice and water mixture is prepared as cubes, each generally having a side length of about ⅓-⅔ of an inside diameter of said coil pipe.

18. The method according to claim 14, wherein:

said connecting the hopper containing an ice and water mixture to a one of said inlet or said outlet includes connecting an ice and water feeding hose to said one of said inlet or said outlet; and said applying suction to said remaining one of said inlet or said outlet includes providing a carriage on which a suction pump for applying said suction via a suction hose and a waste-and-wash water collecting tank for collecting said ice and water mixture exiting from said remaining one of said inlet or said outlet are mounted.

19. The method according to claim 14, wherein said one of said inlet or said outlet to which said hopper is connected is said inlet, and said remaining one of said inlet or said outlet to which said suction is applied is said outlet.

20. The method according to claim 19, further comprising repeating said method wherein said one of said inlet or said outlet to which said hopper is connected is said outlet and said remaining one of said inlet or said outlet to which said suction is applied is said inlet.

21. The method according to claim 20, further comprising repeating said method wherein said one of said inlet or said outlet to which said hopper is connected alternates between being said inlet or said outlet and said remaining one of said inlet or said outlet to which said suction is applied alternates between being a respective remaining one of said inlet or said outlet.

22. The method according to claim 20, wherein said coil pipes are non-corrugated.

* * * * *